United States Patent [19]

Kanai

[11] 3,958,404

[45] May 25, 1976

[54] BALLOON CONTROL RING

[76] Inventor: Hiroyuki Kanai, No. 3-15, Matsunouchi-cho, Ashiya, Hyogo, Japan

[22] Filed: Dec. 11, 1974

[21] Appl. No.: 531,559

Related U.S. Application Data

[62] Division of Ser. No. 284,492, Aug. 29, 1972, Pat. No. 3,863,433.

[30] Foreign Application Priority Data

| | | |
|---|---|---|
| Sept. 2, 1971 | Japan | 46-67756 |
| Oct. 7, 1971 | Japan | 46-79029 |
| May 16, 1972 | Japan | 47-48305 |

[52] U.S. Cl. ..... 57/108; 242/157 R

[51] Int. Cl.[2] ..... B65H 57/22

[58] Field of Search ..... 57/106, 108; 242/157 R, 242/157 C

[56] References Cited

UNITED STATES PATENTS

| | | | |
|---|---|---|---|
| 2,002,078 | 5/1935 | Dickie et al. | 242/157 C |
| 3,094,835 | 6/1963 | Nimtz et al. | 57/106 |
| 3,498,040 | 3/1970 | Argeren | 57/106 X |
| 3,863,433 | 2/1975 | Kanai | 57/106 |

*Primary Examiner*—Jerry W. Myracle
*Assistant Examiner*—Charles Gorenstein
*Attorney, Agent, or Firm*—Stevens, Davis, Miller & Mosher

[57] ABSTRACT

This invention relates to a balloon control ring.

Said balloon control ring has, on its inner surface of the ring proper, a plurarity of ribs arranged in parallel at regular intervals. The ribs are also arranged in such a manner that a yarn contacts the ribs at an angle against the direction of the ribs. The ribs successively overlap each other so that a yarn contacts at the same time the point at which it leaves one rib and the point at which it comes into contact with the next rib. Said balloon control ring proper is fixed to a supporting means which is fixed to the frame of a machine.

Thus the balloon control ring can control ballooning of yarns satisfactorily in the spinning doubling and twisting process and the like of an artificial or synthetic fiber or a mixture of fibers, while allowing a yarn to pass through at a high speed without causing melting, fluffing or breaking of the yarn.

4 Claims, 20 Drawing Figures

BALLOON CONTROL RING

This is a division of Ser. No. 284,492, filed Aug. 29, 1972, now U.S. Pat. No. 3,863,433, issued Feb. 4, 1975.

This invention relates to an improvement in a balloon control ring and the object of it is to provide a balloon control ring capable of controlling ballooning satisfactorily in the spinning, doubling and twisting process and the like of an artificial or synthetic fiber or a mixture of fibers, while allowing yarns to pass through at a high speed without causing melting, fluffing or breaking of yarns.

In the doubling and twisting process of yarns of an artificial or synthetic fiber or a mixture of fibers, especially polyester fiber and a mixture thereof with other fibers, attempts have been made to speed up the operation.

The conventional balloon control ring consists of a ring proper having smooth inner surface with a circular cross section and a supporting means. A running yarn rubs the ring at its inner surface. Therefore, the locus of rubbing of the yarn on the inner surface of the ring proper is a spiral, the center of which coincides with the axle of the spindle and the pitch of which corresponds to the advancing length of the yarn in one revolution of the traveller.

The yarn undergoes intense friction at high speed with the inner surface of the ring in the manner of squeezing in the horizontal direction against the axis of the ring. Therefore, the surface of the yarn becomes hot resulting in the melting, fluffing or breaking of the yarn.

This disadvantage due to the conventional balloon control ring is a stumbling block in attaining a satisfactory high speed operation. The present invention provides a balloon control ring, which overcomes the above-mentioned disadvantage and provides for a high speed operation.

The present invention will be illustrated with reference to the accompanying drawings in which; FIG. 1 is a plane view of a balloon control ring which illustrates one embodiment of the present invention;

Figure 13:
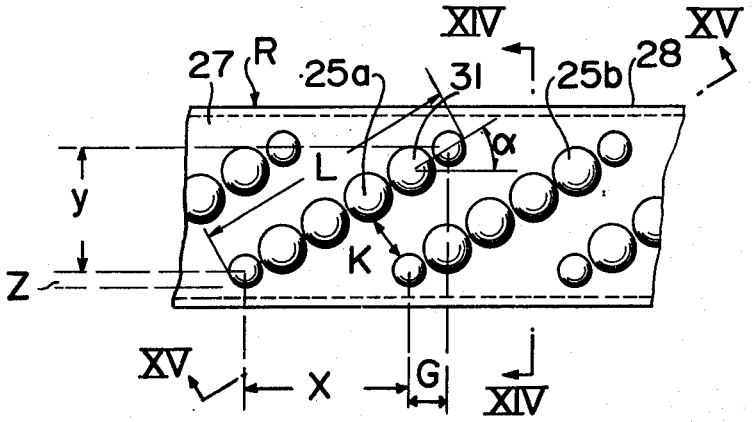
Figure 14:
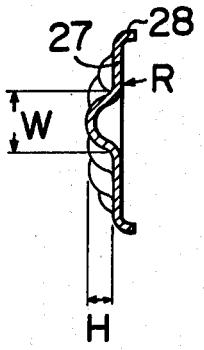
Figure 15:
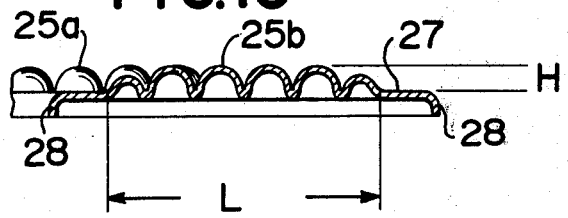
Figure 16:
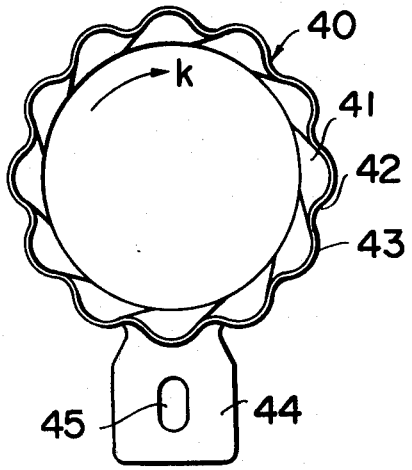
Figure 17:
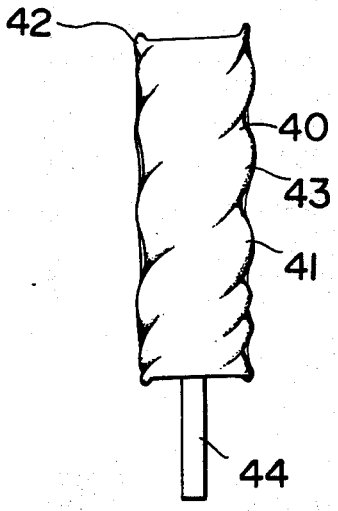
Figure 18:
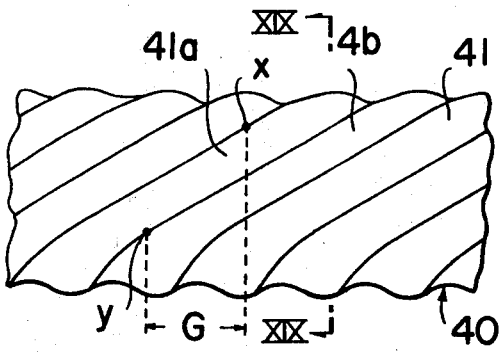
Figure 19:
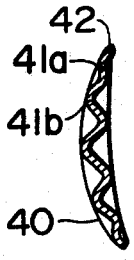
Figure 20:
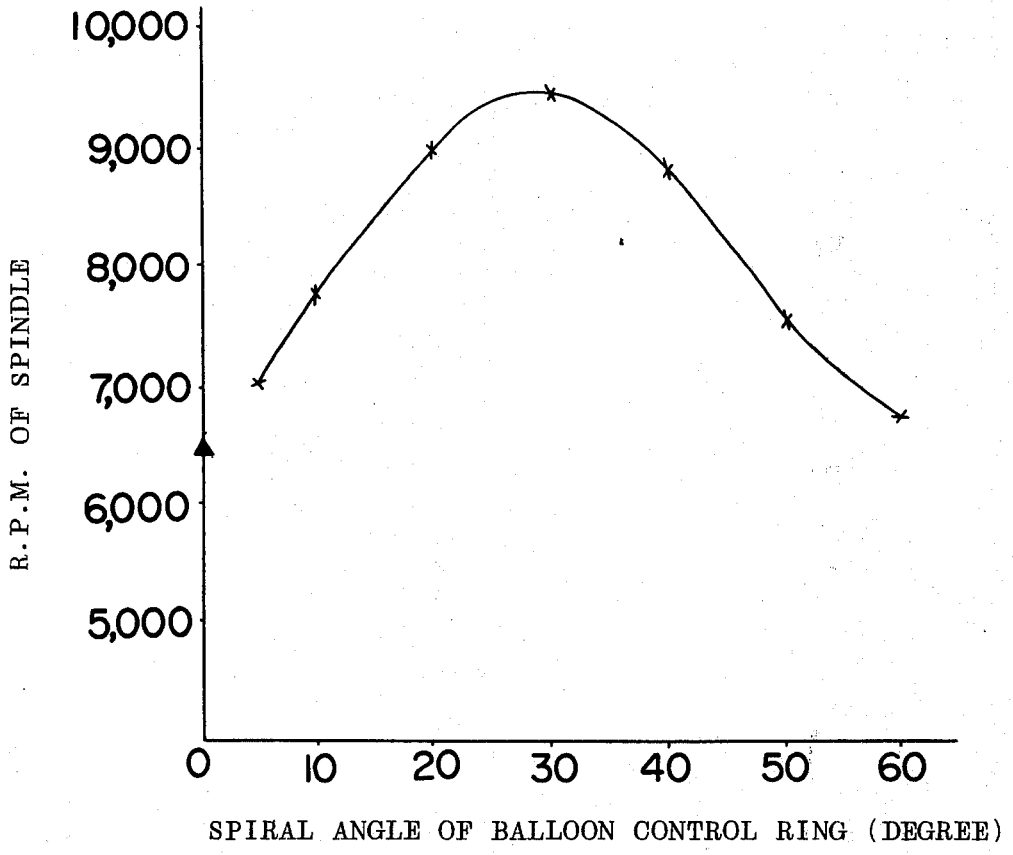

FIG. 13, which illustrates a fourth embodiment of the present invention, is an enlarged fragmentary view as developed of the cylindrical ring R;

FIG. 14 is a view in section taken as indicated by lines and arrows XIV—XIV which appear in FIG. 13;

FIG. 15 is a view in section taken as indicated by lines and arrows XV—XV which appear in FIG. 13;

FIG. 16 is a plan view of a balloon control ring which illustrates a fifth embodiment;

FIG. 17 is a view from the right side of FIG. 16;

FIG. 18 is an enlarged fragmentary view of the inner surface as developed of the cylindrical ring made of corrugated plate shown in FIG. 16;

FIG. 19 is a view in section taken as indicated by lines and arrows XIX—XIX which appear in FIG. 18; and FIG. 20 shows a curve indicating the relation between a spiral angle of the stranded wire of the balloon control ring according to the present invention and the minimum rotation number of a spindle at which the melting of yarns occurs.

Figure 1:
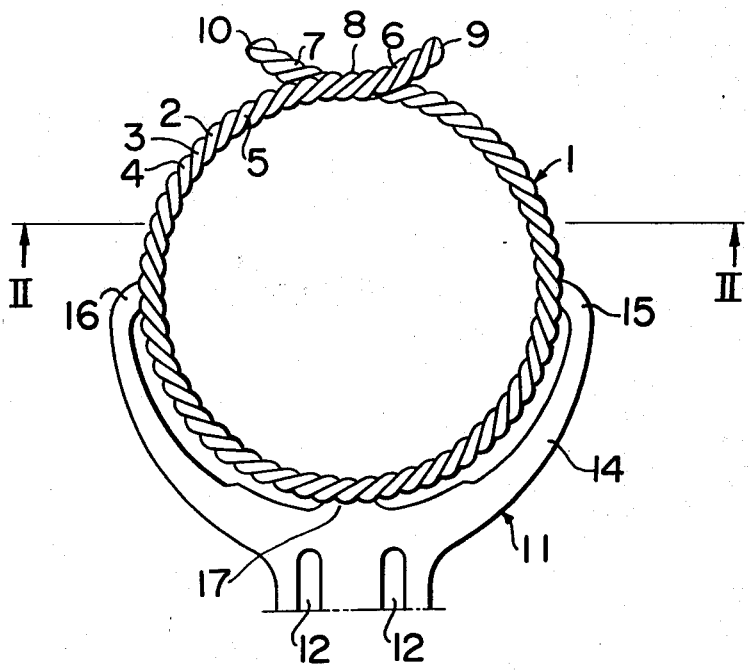
Figure 2:
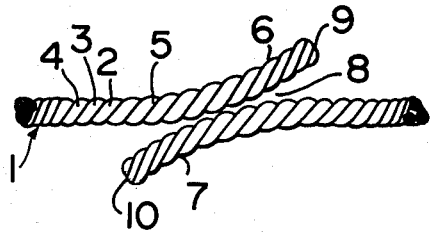
FIG. 2 is a view in section taken as indicated by the lines and arrows II—II which appear in FIG. 1.
Figure 3:
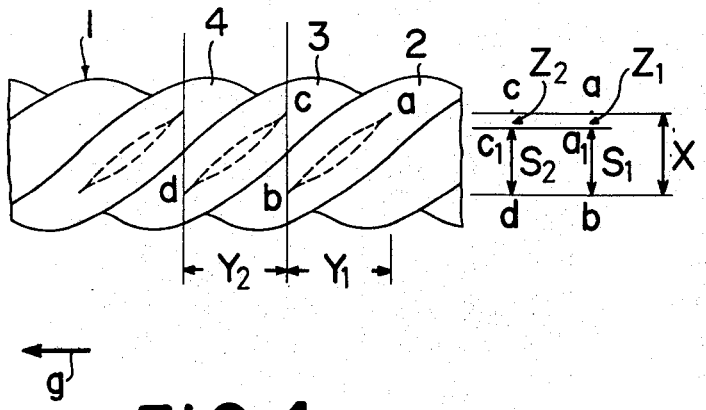
FIG. 3 is an enlarged fragmentary view of the inner surface of the ring shown in FIG. 1.
Figure 4:
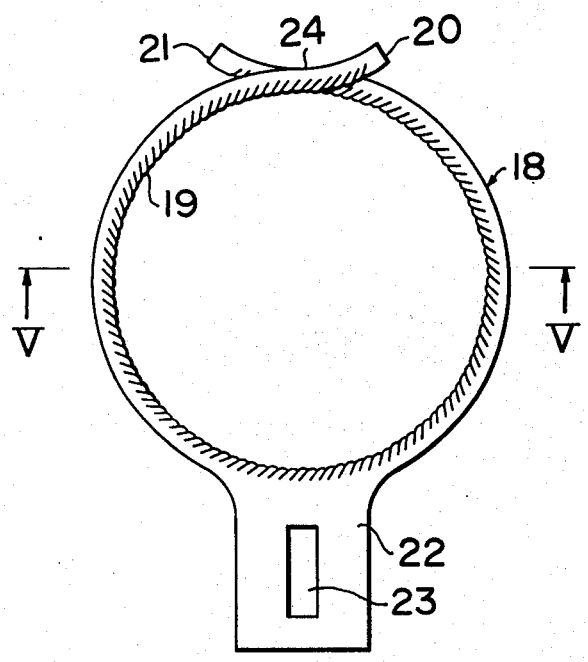
FIG. 4 is a plan view of a balloon control ring which illustrates a second embodiment.
Figure 5:
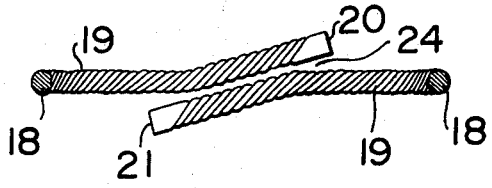
FIG. 5 is a view in section taken as indicated by lines and arrows V—V which appear in FIG. 4.

FIGS. 1 through 3 illustrate the first example of the present invention. As shown in the figures, a balloon control ring proper 1 is made of stranded wire 5. The stranded wire 5 consists of three element wires 2, 3 and 4, each having a circular cross section. The end parts 6 and 7 of the stranded wire 5 overlap each other so as to provide an opening 8 through which a yarn is introduced. The extremities 9 and 10 of the end parts 6 and 7 are respectively fixed firmly by welding, binding or other suitable means so that the strand structure of the element wires 2, 3 and 4 may not be loosened.

In this example, an element wire having a circular cross section is used, however, one having an elliptical or polygonal cross section and so forth also may be used. The number of the element wire to be stranded is not necessarily three but may be any plural number. The material of the element wire may be selected properly, for example, metals or plastics.

Further, the diameter and number of the element wire, the pitch of stranding based on the spiral angle, the stranding direction, etc. may be decided depending upon the conditions under which a stranded wire is used. The spiral angle is made between 10° and 50° against the horizontal direction in which a yarn revolves. If desired, a continuous ring without the opening 8 can be used.

The above-mentioned balloon control ring proper 1 is fixed to the frame of a machine through a supporting means, to which the ring is fixed at the outer part. The supporting means 11 of the example shown in the figure has a fixing arm 13 having fitting holes 12 and supports the ring 1 at both right and left ends 15 and 16 and the center 17 of a semi-circular are supporting arm 14 by welding, binding or other suitable means.

The structure of the balloon control ring of the present invention being thus described, FIG. 3 is to explain the situation in respect of the rubbing between the inner surface of the ring proper and a running yarn. The balloon control ring proper 1 is fixed to the frame of a machine so that the center of the ring is coaxial with the axle of a spindle.

A yarn runs through the ring, and it is twisted and reeled while the ballooning induced by the high speed revolution of the traveller is controlled by the ring. The running yarn revolves at a high speed along the inner surface of the balloon control ring proper 1 with pressing by the tension of the ballooning. When the yarn revolves in the direction indicated by the arrow *g* in FIG. 3, and comes in contact with the element wire 2 at the point *a*, the yarn while moving rubs downwardly along the spiral angle of the element wire and leaves the element wire at the point *b*. Then, the yarn comes in contact with the element wire 3 at the point *c* and is rubbed until it leaves the wire at the point *d*. In this manner, the yarn contacts each of the element wires at the space bounded by a broken line.

Considering now an illustration, the yarn advances for a length of ($Z_1$) while moving along the inner surface of the balloon control ring proper 1 for a distance of ($Y_1$). The length of the yarn in the section between *a* and *b* corresponds to the length (X) on the X-axis, a longitudinal axis. The point *a* of the yarn at which the yarn first comes into contact with the element wire moves downwardly for a distance ($Z_1$), which is the advanced length of the yarn while the yarn moves for a distance ($Y_1$), and reaches the point $a_1$ on the X-axis. Accordingly, the yarn is rubbed downwardly from the point $a_1$ for a length of (X) minus ($Z_1$) or ($S_1$) on the longitudinal axis while the yarn moves for a distance ($Y_1$). The yarn then comes into contact with the point *c*. The point on the yarn which contacts point *c* is above the point *a* by an advancing length of ($Z_1$). Likewise as in the preceding case, the yarn is rubbed from the point *c* to the point *d* while it moves for a distance ($Y_2$). During the moving, the point *c* on the X-axis advances downwardly for the length ($Z_2$) and reaches the point $c_1$ Thus, the yarn is rubbed downwardly from the point $c_1$ for the length ($S_2$). The yarn circulates and advances, then is twisted and reeled while it is continuously rubbed downwardly. As is apparent from the above description, the balloon control ring according to the present invention does not contact a yarn with friction being in the manner of squeezing one point of the yarn in the horizontal direction as in the case with the conventional balloon control ring, but it contacts a yarn in the manner that the contacting part of the yarn moves downwardly covering a long distance. Therefore, the heat to the yarn caused by friction is always distributed and the yarn is prevented from melting.

When a ballooning yarn revolves in the opposite direction to that indicated in the figure, the yarn is rubbed upwardly for a length of (X) plus ($Z_1$) while it moves for ($Y_1$). In practicing the present invention, it is advantageous to use an element wire made of or plated with a metal having a high electric conductivity in order to prevent static charging.

As described above in detail, according to the present example, a balloon can be effectively controlled without bringing about the melting of yarns even when the operation is conducted at high speed. The high speed production of yarns of high quality free from melting and fluffing can be attained.

Figure 7:
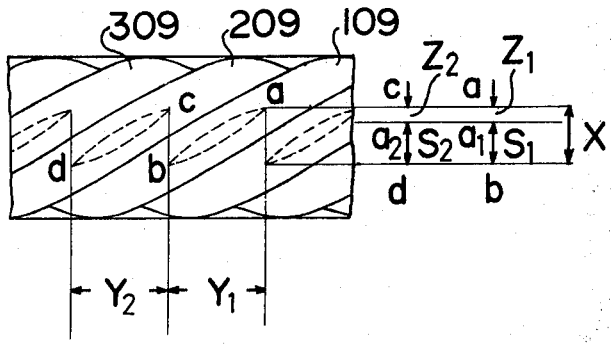
FIG. 7 is a view from the left side of FIG. 6.
Figure 6:
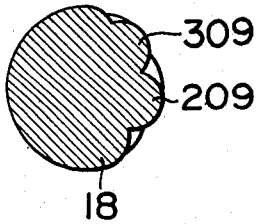
FIG. 6 is an enlarged fragmentary view of FIG. 5.
Figure 8:
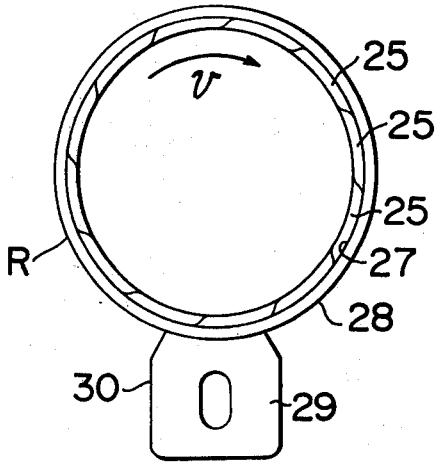
FIG. 8 is a plan view of a balloon control ring which illustrates a third embodiment.
Figure 9:
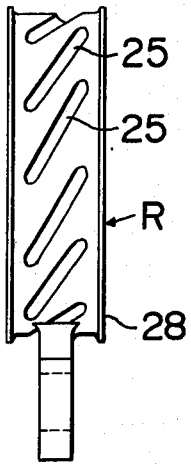
FIG. 9 is a view from the right side of FIG. 8.
Figure 10:
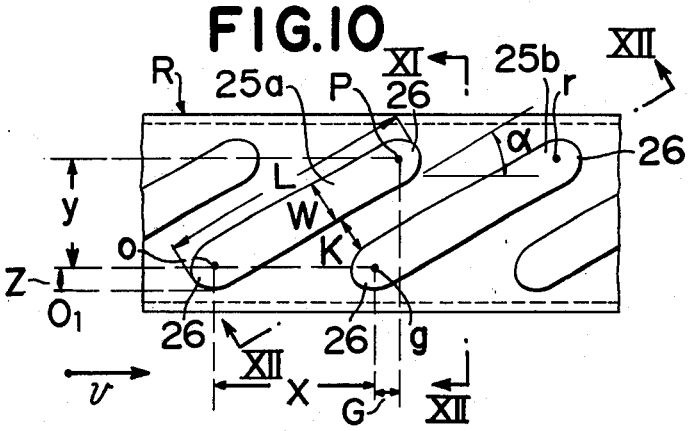
FIG. 10 is an enlarged fragmentary view as developed of the inner surface of the cylindrical ring R shown in FIG. 8.

FIGS. 4 through 7 illustrate a second embodiment of the present invention. A balloon control ring is prepared in the following manner. A wire rod having a circular cross section is threaded on the inner surface 19 with a roulette so as to result in an inner surface like that of a stranded wire consisting of a plurality of elemental wires. In this embodiment, the surface of the threaded rod has a structure of that of a stranded wire consisting of 6 elemental wires, and three out of the six are illustrated in FIG. 7 as 109, 209 and 309. The threaded rod is bent into a ring. The rod has end parts 20 and 21 which overlap each other so as to provide an opening 24 through which a yarn is introduced into the ring. The ring proper 18 is fixed at its out side to a supporting means 22 provided with a fitting hole 23 where the supporting means is fitted to a frame.

In this example, the ring 18 is threaded by cutting only on the inner surface along which a yarn revolves with rubbing. A ring having such a stranded wire-like inner surface 19 may also be obtained by rolling. In this case, the wire rod is subjected to rolling to develop the entire surface into a stranded wire-like surface. The outer part of the wire rod may be cut off. The ring of this embodiment also may be obtained by forging, casting or other conventional means besides cutting and rolling.

The perpendicular height, shape and pitch of the wave, the spiral angle and direction of strand, etc. are selected depending upon the conditions under which the ring is used.

Further, tempering, plating or surface treatment, may be applied, if necessary, to the ring in order to give strength or resistance to friction. Especially, for the purpose of preventing static charging, the ring may be made of or plated with a metal having a high electrical conductivity. It is within the scope of the present invention to prepare a ring proper 18 by framing a material forming the inner surface 19 with other material.

The structure of the balloon control ring of this embodiment being thus described above, the situation between the ring and a yarn in respect of the rubbing, the function and advantages of the ring and the like are similar to those in the foregoing embodiment.

Figure 11:
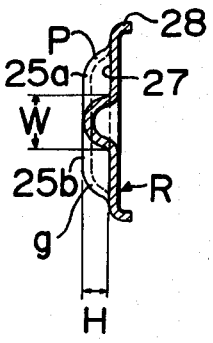
FIG. 11 is a view in section taken as indicated by lines and arrows XI—XI which appear in FIG. 10.
Figure 12:
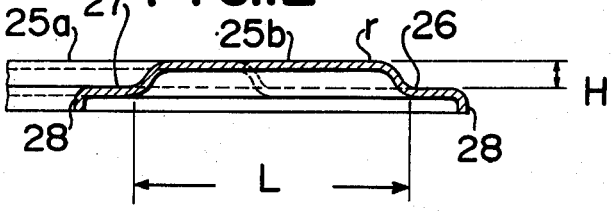
FIG. 12 is a view in section taken as indicated by lines and arrows XII—XII which appear in FIG. 10.

FIGS. 8 through 12 illustrate the third embodiment of the present invention. A balloon control ring has a cylindrical ring with a plurality of ribs on the inner surface. The ribs are arranged aslant against the axis of the ring at regular intervals. Each of the ribs has overlapping portions with the adjacent ribs so that the point at which a yarn leaves one rib and the point at which the yarn comes in contact with the next rib is on the same vertical axis. The figure shows a balloon control ring to be used in the case of Z twist. (R) is a cylindrical ring of a balloon control ring and (V) shows the direction in which a yarn revolves. The ribs are shown by the number 25. As shown in the figure, the ribs have a width of (W), length of (L) and height of (H) and are arranged throughout the inner surface of the cylindrical ring (R) aslant at an angle $\alpha$ against the axis of the ring and at an interval of (K). Each of the ribs has cross sections as shown in FIGS. 11 and 12. A yarn is guided through the end part 26 in the (L) direction of a rib to the overlapping part between the point (g) at which the yarn comes in contact with the rib 25*b* and the point (p) at which the yarn leaves the preceding rib 25*a*. Both of the end parts 26 and 26 in the (L) direction are sloped down and joined to a base 27, thus guiding the yarn smoothly from one rib to the next rib.

Now, when a yarn moves in the direction (V) from the rib 25*a* to the rib 25*b*, the point (g) at which the yarn comes in contact with the rib 25*b* is positioned behind the point (p) at which the yarn leaves the preceding rib 25*a*, by (G) based on the vertical position of the yarn. Thus, each rib has an overlapping portion (G), where the yarn contacts two ribs at one time. 28 is a brim which is curved outwardly as shown in FIG. 11. 29 is a supporting means to which the cylindrical ring (R) is fixed at the outer part by means of welding, fitting, or binding. The supporting means has a fitting hole 30 at which it is fixed to a frame.

In this embodiment, the ring is made of a metal plate. The ribs are arranged by rolling, or pressing and are provided with a surface treatment. The arrangement of the ribs is not necessarily made by a method utilizing the malleability of metals such as rolling, or pressing, but may be made by any other suitable method such as molding, cutting, griding, welding, or binding. Further, the material is not limited to metals but plastics and other suitable materials may also be used. Furthermore, tempering, plating and other suitable surface treatments are applicable. When an opening to introduce a yarn in and out of the ring is necessary as required in the tying operation of a yarn, such an opening is provided by arranging a slit at a space between the ribs aslant in a direction parallel to the ribs. The shape of the ribs, that is, a width (W), length (L) and height (H), and also an angle of inclination of the ribs $\alpha$, interval, (K), overlapping portion (G), shape of the part against which a yarn rubs are suitably selected depending upon the kinds of the fibers employed, purpose and other conditions.

The balloon control ring in this embodiment has the structure as described above. The situation in respect of the rubbing between the inner surface of the ring and a running yarn is described below. The balloon control ring is fixed to the frame of a machine so that the cylindrical ring (R) is coaxial with the spindle. A yarn runs through the ring, and it is twisted and reeled while the ballooning induced by the high speed revolution of the traveller is controlled by the ring. The running yarn revolves at a high speed along the inner surface of the cylindrical ring (R) while pressing the surface by the tension of the ballooning. When the yarn revolves in the direction indicated by the arrows (V) in FIGS. 8 and 10 and comes in contact with the rib 25*a* of the cylindrical ring (R) at the point *o*, the yarn moves upwardly while being rubbed along the surface of the aslant wisely disposed rib until it reaches the point (P). Before the yarn reaches the point (P), it begins to come in contact with the next rib 25*b* at the point *g* because, as mentioned above, the ribs 25*a* and 25*b* have an overlapping portion (G) between the point *g* at which the yarn comes in contact with the rib 25*b* and the point *p*. Accordingly, the yarn moves smoothly from the rib 25*a* to the rib 25*b* and further moves upwardly while being rubbed along the surface of the slantwisely disposed rib 25*b*. In this manner, the yarn moves from one rib to the next successively and revolves along the inner surface of the ring.

Other relations between the ring and the yarn in respect of rubbing, function and advantage of the ring are similar to those of the first embodiment.

A yarn revolves along the ring in the direction indicated by the arrow (V). As the yarn passes through one rib, for example, the rib 25*a*, it moves for a distance designated as (X) between the points *o* and *p* in the advancing direction, namely, in the horizontal direction, while it contacts the ring and is rubbed upwardly for a distance designated as (Y) between the points *o* and *p* in the direction parallel to the yarn, namely, in the vertical direction.

Now, the yarn advances for a length designated as (Z) while it passes through one rib moving for a distance of (X). The point *o* of the yarn at which the yarn first comes into contact with the rib 25*a* moves downwardly for a distance which corresponds to the length the yarn advances while the yarn moves for a distance (X), and reaches the point $o_1$. Accordingly, the yarn is rubbed upwardly from the point $o_1$ for a length of (Y) plus (Z) while the yarn moves for a distance (X). Then the yarn is rubbed upwardly for a length of (Y) plus (Z) at the next rib 25*b* like the preceding rib. In this manner, the yarn revolves and advances while being continuously rubbed upwardly.

As apparent from the above description, the balloon control ring according to this embodiment does not contact the yarn frictionally in such a manner as squeezing one point of the yarn in the horizontal direction as in the case with a conventional balloon control ring, but it contacts the yarn in such a manner that the contacting part of the yarn moves always upwardly in the vertical direction for a long distance. Therefore, the heat to the yarn caused by friction is always distributed, preventing the yarn from melting.

When a yarn revolves in the direction opposite to that indicated in the figure, the yarn is rubbed downwardly, contrary to the foregoing case. In this case, the yarn (Y) moves upwardly for a length corresponding to distance (Y) while a yarn moves for length (X).

As described above in detail, according to the present example, a balloon can be effectively controlled without bringing about the melting of yarns even when the operation is conducted at high speed. The high speed production of yarns of high quality free from the melting and fluffing can be attained.

FIGS. 13 through 15 illustrate the fourth embodiment of the present invention. As in the case with the balloon control ring of the preceding embodiment, a balloon control ring in this embodiment has a plurality of ribs arranged in parallel and aslant at an angle of $\alpha$ on the inner surface of the cylindrical ring. A rib comprises a series of several small projections 31 in a semispherical shape. The base of a projection may be circular, polygonal or of other suitable shape. However, the top portion of the projection against which the yarn rubs must be smoothly spherical, and also have "overlapping portion" so that an undesirable rubbing or vibrations may not be transferred to the yarn. Accordingly, in this example a rub contacts the yarn not as a slantwise straight line as in the case with the preceding embodiment but as an accumulation of a broken line.

Other functions and advantages of the balloon control ring of this embodiment are similar to those of the preceding embodiment.

FIGS. 16 through 19 illustrate the fifth embodiment of the present invention. 40 is a cylindrical ring made of a corrugated plate, with ridges 41 and troughs 42. Said ridges correspond to the term "rib" mentioned in the proceeding embodiments. Both of the rims 43 of the ring are outwardly curved. 44 is a supporting means to which the ring is fixed at the outer part and 45 is a fitting hole. *k* indicates the direction in which a yarn circulates.

The ring 40 shown in the figure is a cylinder made of a corrugated plate and has on its inner surface, a plurality of ridges 41 disposed aslant at an angle of 10° to 50° against the horizontal direction *k* in which a yarn revolves. In the figure is shown the case where the angle is 30° and where the ridges are disposed so that the point at which a yarn leaves a ridge is ahead of the point where the yarn comes in contact with the next ridge. For example, the point *x* at which a yarn leaves the ridge 41*a* is ahead by (G) of the point *y* at which the yarn comes in contact with the next ridge 41b. The rims 42 are sufficiently curved outwardly, thus preventing a ballooning yarn from breaking by contact with the corrugated rims of the ring.

The corrugated cylindrical ring 40 having outwardly curved rims is readily prepared by shaping a metal plate of stainless steel with a roller or a press. Further, each of the ribs 41 is slightly swollen inwardly at the longitudinal middle part. Therefore, the curve of the vertical section of the inner surface may be adequately fitted to the curve of the ballooning yarn. This is effective in that the pressure from contact of the yarn on the inner surface of the ring is uniformly distributed.

The material of the ring is not limited to a metal plate but may be selected as desired. The inner surface may be applied with heat treatment and surface treatment. One made from a stainless steel and applied with a nitriding treatment is especially effective. Further, the shape of a corrugated plate, the height of the ridge, the depth of the trough, the pitch, the angle of inclination of the ridge, the width of the overlapping portion, or the height of the cylindrical ring, may be appropriately selected depending upon the kinds of fibers to be employed and, the conditions under which fibers are spinned.

Thus described is the structure of the balloon control ring of this embodiment. In practicing the present embodiment, the ring is fixed to the frame of a machine. A yarn runs through the ring, and it is twisted and reeled while the ballooning induced by the high speed revolution of the traveller is controlled by the ring 40. The running yarn revolves at a high speed along the inner surface of the balloon control ring 40 with pressing by the tension of ballooning. When the yarn revolves in the direction indicated by the arrow *k*, and first comes in contact with the inner surface of the ring at the ridge 41*a*, the yarn moves while being rubbed upwardly along the surface of the slant ridge 41*a* and reaches the point *x* at which point it leaves the ridge.

When the yarn reaches the point *x*, it has already begun rubbing the next ridge 41*b* for a distance corresponding to the overlapping portion (G) from the point *y*. The yarn leaves the point *x* and further moves while being rubbed upwardly along the surface of the slant ridge 41*b* in the same manner as in the case with the preceding ridge 41*a*.

In this manner, the yarn revolves and advances while being continuously rubbed upwardly in the vertical direction.

Thus, the balloon control ring according to the present example does not contact the yarn frictionally in such a manner as squeezing one point of the yarn in the horizontal direction as in the case with the conventional balloon control ring, but it contacts the yarn in the manner that the contacting part of the yarn moves upwardly covering a long distance. Therefore, the heat to the yarn caused by friction is always distributed resulting in the prevention of the yarn from melting. Further, since the ring is made of a corrugated plate, it has about 1.6 times larger area for heat radiation than that made of a flat plate and, at the same time, has a bigger effect in the dissipation by air-cooling. These advantages being combined, the balloon control ring of this embodiment overcomes the disadvantage of the conventional ring, that is, the melting of the yarn. In addition, the ring can be readily produced.

As described above in detail, according to the present example, since balloon can be effectively controlled without bringing about the melting of yarn even when the operation is conducted at a high speed. The high speed production of yarns of high quality free from melting and fluffing can be attained.

Now, an experiment was conducted to determine the relation between a spiral angle (or an angle of inclination) of the balloon control ring having a structure described in the first, second, third, fourth or fifth embodiment and the minimum rotations of a spindle at which the melting of a yarn occurs. The result is shown in FIG. 16. In the experiment, a polyester filament of 1100 deniers, the most common on the market, was used.

The balloon control ring used had a diameter of 145 mm. As is apparent from FIG. 16, when the spiral angle was in a range between 10° and 50°, it was recorded that the melting of the yarn occurred at a rotation of the spindle of 7000 to 9500 rpm. It can also be seen from the figure that especially the spiral angle ranging from 20° to 40° is most preferable. When the conventional ring without ribs was used, a melted yarn was produced at a rotation of 6500 rpm as shown by (▲) in FIG. 20. This clearly shows the advantage of the present balloon control ring over the conventional one.

In the present invention, when an angle of inclination of the ribs is less than 10°, the effect of the present invention can not be expected for the following reasons. That is, or one thing, in the case of the ring of a stranded wire, it is almost impossible to strand elemental wires at such an angle. In addition to this, even if possible, a ring having the ribs arranged in such a state has an inner surface like that of the conventional ring consisting of a wire rod having a circular cross section. Accordingly, when a yarn circulates along such an inner surface at high speed, the heat produced by horizontally squeezed friction exceeds the distribution of heat effected by the rubbing of the yarn vertically against the slant surface of the rib, and the effect of the present invention can not be achieved.

Also when the angle of inclination exceeds 50°, it is impossible to arrange an overlapping portion, and the inner surface of the ring takes the form of an uneven surface, resulting in disadvantages. For example, when a yarn moves while rubbing along such an inner surface in the horizontal direction, it is subjected to vibration.

As mentioned above, polyester filaments were used in this experiment. Similar effects can be of course expected when such synthetic fibers as nylon-fiber, acetate fiber, polyacryl fiber, polyethylene fiber, polypropylene fiber and the like are used.

What is claimed is:

1. A balloon control ring through which a yarn is to pass having a ribbed inner surface over which the yarn rubs as it revolves and advances through the ring, the ribs on the inner surface being generally parallel to one another and extending at an angle of between 10° and 50° to the circular line at which the central plane in which the ring lies intersects the said inner surface, the arrangement being such that as a yarn revolves and passes over each successive rib, it engages each rib as or before it leaves the preceding rib, said ring being fixed to a supporting means through which it is fixed to the frame of a machine, said ring being a wire rod and said ribs being arranged on the inner surface of the rod proper to give such an inner surface like that of a stranded wire.

2. A balloon control ring through which a yarn is to pass having a ribbed inner surface over which the yarn rubs as it revolves and advances through the ring, the ribs on the inner surface being generally parallel to one another and extending at an angle of between 10° and 50° to the circular line at which the central plane in which the ring lies intersects the said inner surface, the arrangement being such that as a yarn revolves and passes over each successive rib, it engages each rib as or before it leaves the preceding rib, said ring being fixed to a supporting means through which it is fixed to the frame of a machine, said balloon control ring proper being made of a cylindrical ring having on its inner surface a plurality of ribs arranged at an angle to the axis of the ring parallel to each other at regular intervals and the top part of each of said ribs being a rounded surface.

3. The balloon control ring according to claim 1, wherein the balloon control ring proper is made of a cylindrical ring on the inner surface of which a plurality of ribs each consisting of a series of several semi-spherical small projections is arranged at an angle to the axis of the ring and parallel to each other at regular intervals.

4. A balloon control ring through which a yarn is to pass having a ribbed inner surface over which the yarn rubs as it revolves and advances through the ring, the ribs on the inner surface being generally parallel to one another and extending at an angle of between 10° and 50° to the circular line at which the central plane in which the ring lies intersects the said inner surface, the arrangement being such that as a yarn revolves and passes over each successive rib, it engages each rib as or before it leaves the preceding rib, said ring being fixed to a supporting means through which it is fixed to the frame of a machine, and said balloon control ring proper being made of a corrugaged cylindrical plate with the ridges of the corrugations forming said ribs and being disposed at an angle to the horizontal direction in which a yarn revolves.

* * * * *